US009413126B2

(12) United States Patent
Pocrass

(10) Patent No.: US 9,413,126 B2
(45) **Date of Patent: *Aug. 9, 2016**

(54) COMBINATION USB CONNECTOR AND MICROSD FLASH CARD CONNECTOR

(71) Applicant: Alan L. Pocrass, Simi Valley, CA (US)

(72) Inventor: Alan L. Pocrass, Simi Valley, CA (US)

(73) Assignee: Alan L. Pocrass, Simi Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/242,033

(22) Filed: Apr. 1, 2014

(65) Prior Publication Data

US 2014/0315431 A1 Oct. 23, 2014

Related U.S. Application Data

(60) Provisional application No. 61/854,398, filed on Apr. 23, 2013.

(51) Int. Cl.

| | |
|---|---|
| ***H01R 27/02*** | (2006.01) |
| *H01R 13/658* | (2011.01) |
| *H01R 12/50* | (2011.01) |
| *H01R 31/06* | (2006.01) |
| *H01R 27/00* | (2006.01) |
| *H01R 13/6581* | (2011.01) |

(52) U.S. Cl.

CPC ..... *H01R 27/02* (2013.01); *H01R 13/658* (2013.01); *H01R 13/6581* (2013.01); *H01R 13/65802* (2013.01); *H01R 23/6873* (2013.01); *H01R 27/00* (2013.01); *H01R 31/06* (2013.01)

(58) Field of Classification Search

CPC .... H01R 27/00; H01R 31/065; H01R 23/025; H01R 31/06; H01R 23/7073; H01R 13/658; H01R 13/65802; H01R 23/6873

USPC ..... 439/607.01, 607.31, 607.32, 638, 630

See application file for complete search history.

(56) References Cited

U.S. PATENT DOCUMENTS

| | | | | |
|---|---|---|---|---|
| 6,676,419 | B1 * | 1/2004 | Lin | G06K 19/077 439/131 |
| 8,206,161 | B1 * | 6/2012 | Lan | H01R 13/6586 439/607.22 |
| 8,286,879 | B2 * | 10/2012 | Chang | G06K 19/07739 235/441 |
| 8,485,843 | B2 | 7/2013 | Chang | |
| 2009/0065593 | A1 * | 3/2009 | Higuchi | G06K 19/0719 235/492 |
| 2010/0123006 | A1 * | 5/2010 | Chen | G06K 7/0021 235/441 |
| 2010/0279526 | A1 * | 11/2010 | Chiang | H01R 27/00 439/131 |
| 2012/0129393 | A1 * | 5/2012 | Peng | H01R 27/02 439/607.01 |
| 2014/0315406 | A1 * | 10/2014 | Pocrass | H01R 24/64 439/217 |

FOREIGN PATENT DOCUMENTS

| | | |
|---|---|---|
| TW | M423939 U1 | 3/2012 |

* cited by examiner

*Primary Examiner* — Abdullah Riyami
*Assistant Examiner* — Justin Kratt
(74) *Attorney, Agent, or Firm* — The Webb Law Firm

(57) ABSTRACT

A combination female USB connector and female MicroSD flash card connector include walls defining a housing in which a female USB connector and a female MicroSD flash card connector are disposed. Contact pins extend from contacts of the female USB connector and contacts of the female MicroSD flash card connector through at least one wall of the housing for connection to a printed circuit board. The walls include electromagnetic interference (EMI) shielding.

6 Claims, 4 Drawing Sheets

PIN OUT

USB

THE STANDARD USB A PLUG (LEFT) AND B PLUG (RIGHT)

| | |
|---|---|
| PIN 1 | Vcc (+5 V) |
| PIN 2 | DATA − |
| PIN 3 | DATA + |
| PIN 4 | GROUND |

TYPE A

TYPE B

MINI-A

MINI-B

MICRO-A

MICRO-B

COMBINATION USB CONNECTOR AND MICROSD FLASH CARD CONNECTOR

CROSS REFERENCE TO RELATED APPLICATION

This application claims priority from U.S. Provisional Application No. 61/854,398, filed Apr. 23, 2013, which is incorporated herein by reference.

BACKGROUND OF THE INVENTION

1. Field of the Invention

The present invention relates to the combination of a USB connector and a MicroSD flash card connector in a common housing. The MicroSD flash card connector can be used with standard MicroSD flash cards. The connectors can be one on top of the other or side-by-side to each other in the common housing which can include shielding.

2. Description of Related Art

USB connectors are electrical connectors that are used for networking and computer products, such as desk-top computers, laptops, tablets, cellphones, and other products which require connections to peripheral devices. USB connectors are used in many industries.

Universal Serial Bus (USB) is an industry standard developed in the mid-1990's that defines the cables, connectors and communications protocols used in a bus for connection, communication and power supply between computers and electronic devices.

USB was designed to standardize the connection of computer peripherals including keyboards, pointing devices, digital cameras, printers, portable media players, disk drives and network adapters to personal computers both to communicate and to supply electric power. It has become commonplace on other devices, such as smartphones, PDAs and video game consoles. USB has effectively replaced a variety of earlier interfaces, such as serial and parallel ports, as well as separate power chargers for portable devices.

The USB standard evolved through several versions before its official release in 1996. The first version USB 1 (Full Speed) is one type of USB connector. Released in January 1996, USB 1 specified data rates of 1.5 Mb/s (Low-Bandwidth) and 12 Mb/s (Full-Bandwidth). It did not allow for extension cables or pass-through monitors (due to timing and power limitations). Few USB devices made it to market until USB 1.1, released in August 1998, which fixed problems identified in USB 1.0, mostly relating to hubs. USB 1.1 was the earliest revision that was widely adopted.

The second version was USB 2.0 (High Speed) USB 2.0. Released in April 2000, USB 2.0 added higher maximum signaling rate of 480 Mbit/s (effective throughput up to 35 MB/s or 280 Mbit/s) (now called "Hi-Speed"). Further modifications to the USB specification have been done via Engineering Change Notices (ECN). The most important of these ECNs were included into the USB 2.0 specification package available from USB.org.

The third version, USB 3.0, was released in November 2008. The USB 3.0 standard defines a new "SuperSpeed" mode with a raw signaling speed of 5 Gbit/s and a usable data rate of up to 4 Gbit/s. USB 3.0 reduces the time required for data transmission, therefore reducing power consumption, and it is backward compatible with USB 2.0. The USB 3.0 Promoter Group announced on 17 Nov. 2008 that the specification of version 3.0 had been completed and had made the transition to the USB Implementers Forum (USB-IF), the managing body of USB specifications. This move effectively opened the specification to hardware developers for implementation in products. The new "SuperSpeed" bus provides a fourth transfer mode at 5.0 Gbit/s (raw data rate), in addition to the modes supported by earlier versions. As with previous USB versions, USB 3.0 ports come in low-power and high-power variants, providing 150 mA and 900 mA respectively while simultaneously transmitting data at SuperSpeed rates. Additionally, there is a Battery Charging Specification (Version 1.2—December 2010), which increases the power handling capability to 1.5 A but does not allow concurrent data transmission. The Battery Charging Specification requires that the physical ports themselves be capable of handling 5 A of current but the specification limits the maximum current drawn to 1.5 A.

A January 2013 press release from the USB group reveals plans to update USB 3 to 10 Gbit/s to put it on par with other type of emerging connectors like the Thunderbolt® connector. Thunderbolt® is a U.S. registered trademark of Apple, Inc. of Cupertino, Calif., Reg. No. 1,078,726.

There are several types of USB connectors, including some recently added ones. The original USB specification includes Standard-A and Standard-B plugs (FIG. 2) and receptacles; the -B connector enabled cabling to be plugged at both ends while preventing users from connecting one computer receptacle to another. FIGS. 3A-3F show different types of USB-A and -B connectors including standard, mini, and micro types.

The USB type-A plug (FIG. 3A) is a flattened rectangle that inserts into a "downstream-port" receptacle on the USB host or a hub, and carries both power and data. The USB type-A plug is frequently seen on cables that are permanently attached to a device, such as one connecting a keyboard or mouse to the computer via USB connection.

A USB type-B receptacle (FIG. 3B) has a square shape with beveled exterior corners and is configured to mate with an "upstream receptacle" on a device that uses a removable cable, e.g. a printer. On some devices, the USB type-B receptacle has no data connections, being used solely for accepting power from the upstream device.

The USB Mini-A plugs (FIG. 3C) and USB Mini-B receptacles (FIG. 3D) are approximately 3 by 7 mm. These mini-USB plugs and receptacles have a similar width and approximately half the thickness of USB type-A plugs and -B receptacles, enabling their integration into thinner portable devices.

USB Micro-A (FIG. 3E) and Micro-B (FIG. 3F) connectors were announced by the USB-IF on 4 Jan. 2007. The Mini-A plug and the Mini-B receptacle were deprecated on 23 May 2007. While many currently available devices and cables still use Mini connectors, the newer Micro connectors were being widely adopted as of December 2010. The thinner USB Micro-A and -B connectors are intended to replace the Mini USB connectors in new devices including smartphones, personal digital assistants, and cameras.

USB connectors are inexpensive, relatively simple to assemble, and easy to plug and unplug. A USB connector typically has a plastic body, with no locking mechanism to lock the male and female into place when connected.

USB female connectors (or receptacles) have socket houses for insertion of male USB plugs to form a connection. The housings are available in many configurations including a one port, multiple ports in a horizontal row, vertical, and stackable connectors which are stacked rows of USB connectors.

MicroSD is a very small removable flash memory card, used, for example, with mobile phones, tablets, laptops and desktop computers to store content. It is the smallest flash memory card currently on the market. It measures just 5 mm×11 mm×0.7 mm, making it perfect for mobile phone and tablet computer use. When users want to insert the card into a MicroSD card connector, they simply slide the card into the connector opening and it locks into place.

Although MicroSD cards are physically very small, they can store large amounts of data. MicroSD cards are available with flash storage capacities ranging from 128 MB up to 4 GB, using a storage density of 34 GB/cm$^3$. There are different formats on MicroSD cards used to store the data, including the SDHC format. Current capacities are 4 GB, 8 GB, 16 GB, 32 GB, 64 GB and 128 GB. This capacity may increase in the future and stay in the same MicroSD form factor.

SDHC stands for Secure Digital High Capacity. SDHC cards, as the name suggests, provide higher storage capacity in a card with the same form factor as a normal Secure Digital (SD) card. SDHC cards first appeared in 2006. SDHC cards are generally formatted with the Fat32 file system. SDHC cards have a fixed sector size of 512 bytes.

The SD Card Association (SDA) has placed a limit of 32 GB on SDHC capacity, while technically speaking it could support up to 2 terabytes (TB) of storage. SDHC cards emerging onto the market created considerable consumer confusion as normal SD cards are used for many portable devices including digital cameras, camcorders, game systems, MP3 players and other electronic devices. SDHC cards are also graded by speed in three classes. Generally speaking, Class 2 offers 2 MB/sec, Class 4 offers 4 MB/sec and Class 6 offers 6 MB/sec.

SUMMARY OF THE INVENTION

Disclosed herein is the combination of a female MicroSD card connector and a female USB connector in a common housing. When the MicroSD card connector is combined with the USB connector in the common housing there is a saving of space on a substrate, e.g., a printed circuit board, once they are installed as a unitary unit versus installing them as two separate connectors.

The combination MicroSD card connector and USB connector can be mounted onto a printed circuit board in different manners depending on how the contact pins from each connector are positioned in the common connector housing. The contact pins can extend at right angle and through the bottom wall of the connector housing for insertion into a printed circuit board. Optionally the contact pins can be positioned vertically to extend through the back or rear wall of the connector housing for insertion into a printed circuit board. Conventional USB connectors and conventional MicroSD card connectors can be mounted in these different arrangements as well. The contact pins of these conventional connectors generally have symmetric orientation which keeps the size of the connector to a minimum. The symmetric orientation of the connectors in a common housing disclosed herein conserves space.

Also disclosed is a USB female connector and MicroSD card connector combined into one connector body which can be attached to a substrate, e.g., a printed circuit board, to save space and provide for the transfer and storage of data within the body. The MicroSD card connector provides a means to read and write data from and to a MicroSD flash card which can be inserted into the MicroSD card connector. The common connector housing that houses the combination of the USB connector and the MicroSD card connector can have shielding surrounding and encasing them together.

Also disclosed is a USB connector and a MicroSD card connector combined in a common connector housing in a manner to provide the capability of the USB connector for use in connecting peripherals and the other features of USB capability and with the MicroSD card connector for transfer and/or storage of data from/to a MicroSD card. It is envisioned that there exists applications where data storage on a MicroSD card inside the common connector housing can add value by being used to accumulate data related to the status of the USB connector of the common housing. This status data can include activity on the USB connector including number of connections. As is known in the art, MicroSD cards are capable of holding vast amounts of data and can be used to store files, folders, and any other data a user may want to store.

MicroSD flash cards which insert into the MicroSD card connector of the common connector housing described herein are typically smaller than the dimensions of a standard USB connector opening of said common connector housing and therefore said common connector housing has a width and height and depth substantially the same as a conventional USB connector. In addition to a female MicroSD card connector, other types of female Flash card connectors, or HDMI or SATA connectors, could be used in replacement of the female MicroSD card connector in the common connector housing. The same height and size of the common connector housing can be maintained when other types of flash card readers connectors (HDMI connectors or SATA connectors) are used in replacement of the female MicroSD card connector in the common connector housing hereof.

Also disclosed is a method of attaching connectors of all types used in the networking and computer industry. The method includes combining connectors and stacking them above or below each other in a common housing to increase the density of connectors in a common connector housing. The connectors can be shielded or unshielded.

More specifically, disclosed herein is a combination female USB connector and female MicroSD flash card connector comprising: a plurality of walls defining a housing; a female USB connector and a female MicroSD flash card connector inside the housing; contact pins extending from contacts of the female USB connector and contacts of the female MicroSD flash card connector through at least one wall of the housing for connection to a substrate; and electromagnetic interference (EMI) shielding on one or more of the walls.

The plurality of walls can include top and bottom walls, right and left side walls extending between the top and bottom walls, and a rear wall.

The female USB connector and female MicroSD flash card connector can be positioned adjacent each other vertically (one atop of the other) or horizontally (side-by-side) within the housing.

The housing can include in one of the plurality of walls: a first opening configured to facilitate insertion of a male USB connector into the female USB connector; and a second opening configured to facilitate insertion of a MicroSD flash card into the female MicroSD flash card connector.

The combination female USB connector and female MicroSD flash card connector can further include a first integrated circuit (IC) chip in the housing. The first IC chip can be operative for analyzing network transmission data on one or more contact pins of the female USB connector and for storing said data in a memory of a MicroSD flash memory card inserted in the female MicroSD flash card connector.

Also or alternatively, the combination female USB connector and female MicroSD flash card connector can further include a second integrated circuit (IC) chip in the housing. The second IC chip can be operative for facilitating electrical connectivity between contacts of a male USB connector and the contacts of the female USB connector when the male USB connector is inserted into the female USB connector. The second IC chip can be further operative for collecting and storing connectivity data in a memory of a MicroSD flash memory card inserted in the female MicroSD flash card connector.

The female USB electrical connector can be a USB type-A connector, or a USB type-B connector, or a USB type mini-A connector, or a USB type mini-B connector, or a USB type micro-A connector, or a USB type micro-B connector.

DETAILED DESCRIPTION OF THE INVENTION

The present invention will be described with reference to the accompanying figures where like reference numbers correspond to like elements.

Figure 1A:
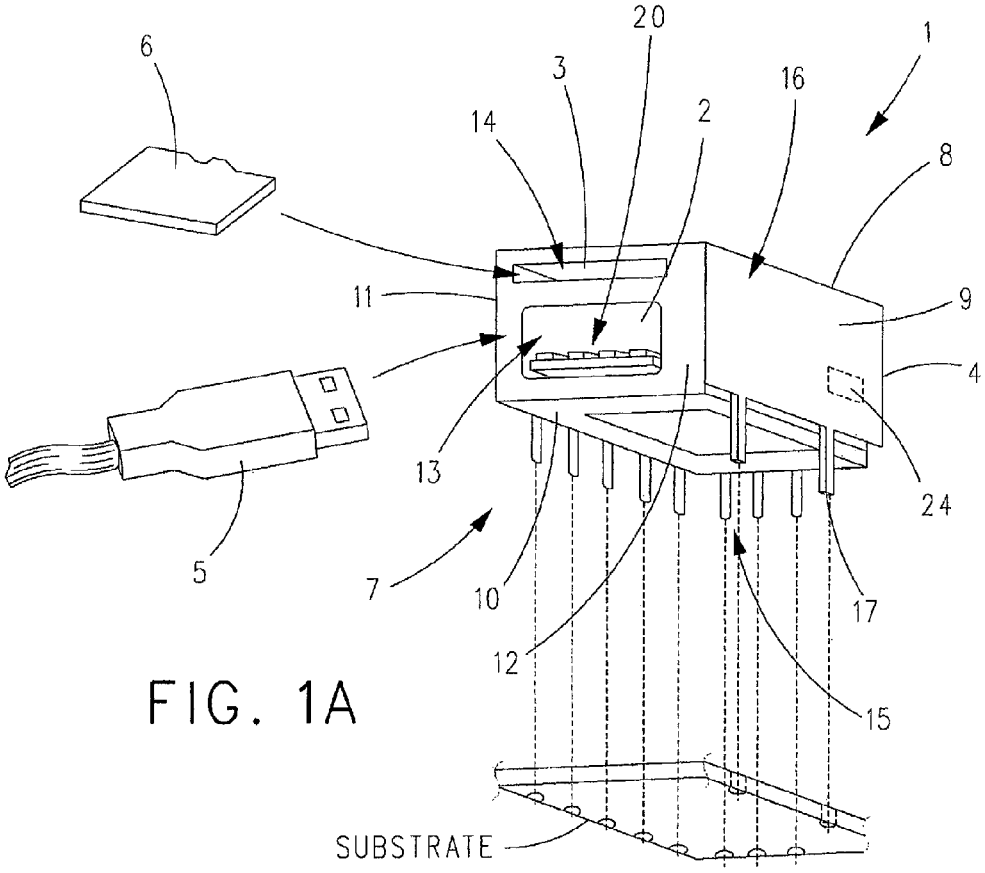
FIGS. 1A and 1B are respective perspective and schematic views of a combination female USB connector and a female MicroSD flash card connector (reader/writer) in a common housing in accordance with an embodiment of the present invention.
Figure 1B:
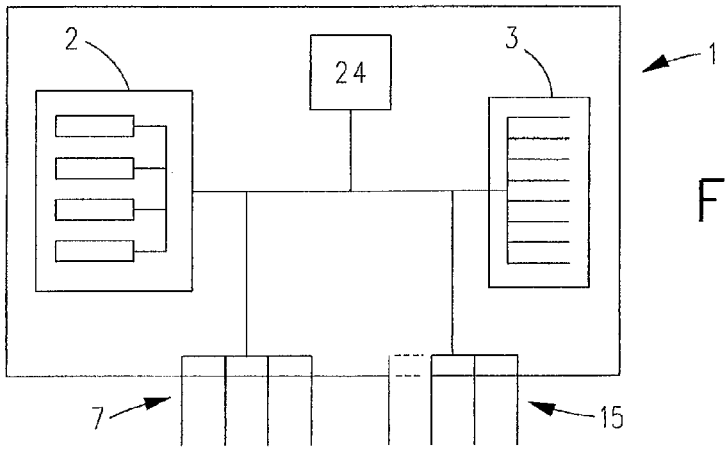
Figure 2:
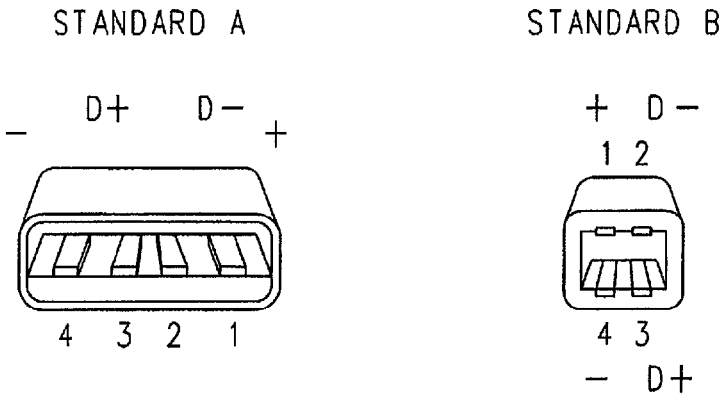
FIG. 2 (PRIOR ART)
FIG. 2 is a perspective view of prior art standard USB type-A and type-B connectors and a pin-out chart for said connectors.
Figure 3A:
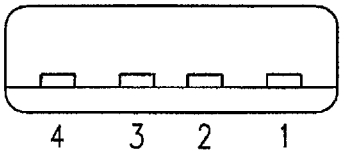
FIG. 3A (PRIOR ART)
FIGS. 3A-3F are schematic views of prior art USB connectors including Standard Type-A and Type-B, Mini-A and Mini-B, and Micro-A and Micro-B.
Figure 3B:
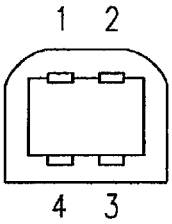
FIG. 3B (PRIOR ART)
Figure 3C:
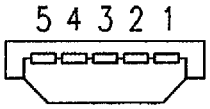
FIG. 3C (PRIOR ART)
Figure 3D:
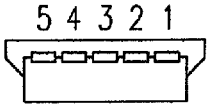
FIG. 3D (PRIOR ART)
Figure 3E:
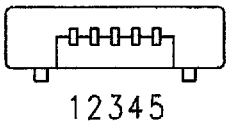
FIG. 3E (PRIOR ART)
Figure 3F:
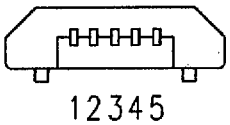
FIG. 3F (PRIOR ART)

With reference to FIGS. 1A and 1B, a combination USB connector and MicroSD flash card connector 1 includes a female USB connector 2 and a female MicroSD flash card connector 3 in a common housing that includes a rear wall 4, a top wall 8, a right side wall 11, a left side wall 9, a front wall 12, and a bottom wall 10. USB connector 2 and MicroSD connector 3 are located and contained within these walls with a USB opening 13 for insertion of a male USB connector 5 and with a card reader opening 14 for insertion of a MicroSD flash card 6.

While the embodiment shown in FIGS. 1A and 1B is described as having MicroSD card connector 3, this is not to be construed as limiting the invention since it is envisioned that MicroSD card connector 3 may be replaced by any other suitable and/or desirable flash memory card connector, HDMI connector, SATA connector, and the like whereupon the common housing will include USB connector 2 and one of these other connectors. Also or alternatively, it is envisioned that the common housing can be adapted to include other connectors (in addition to female USB connector 2 and female MicroSD card connector 3) such as, flash memory card connectors, HDMI connectors, SATA connectors, and additional USB connectors as deemed suitable and/or desirable.

FIGS. 1A and 1B show USB connector 2 and MicroSD card connector 3, example contact pins 7 from USB connector 2, example contact pins 15 from MicroSD card connector 3, optional EMI shielding 16 on at least walls 4, 8, 9, 10, and 11, and optionally wall 12, and an optional shielding tab 17 connected to EMI shielding 16. Shielding 16 can be made of any suitable and/or desirable electrically conductive and magnetically susceptible material. USB connector 2 and the MicroSD card connector 3 can be made from any suitable and/or desirable material or combination of materials, such as, without limitation, plastic and/or metal.

Figure 4:
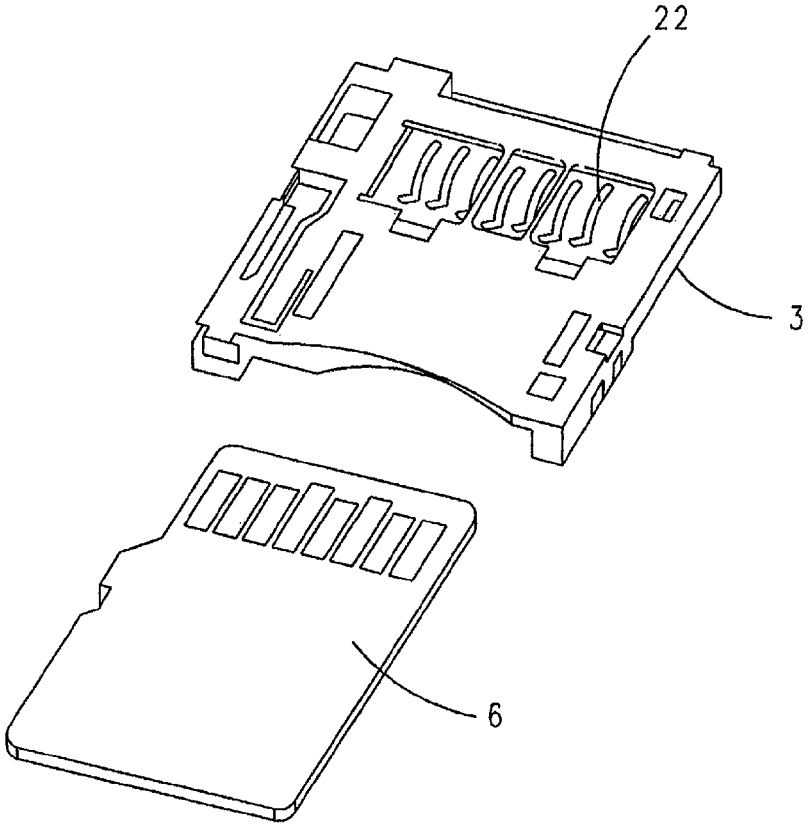
FIG. 4 (PRIOR ART)
FIG. 4 is an isolated perspective view of a prior art female Micro SD flash card connector (reader/writer) included in the common housing of FIG. 1A in operative relation to a MicroSD card positioned for insertion into the MicroSD card connector.

Contacts 20 of USB connector 2 can connect electrically with contact pins 7 which extend within the interior of the common housing through any one or more of walls 4, 8, 9, 10, or 11 to be mounted to a substrate, e.g., a printed circuit board, by soldering, surface mount technology, press fitting, or other means of mounting connectors to printed circuit boards known in the art. Similarly, contacts 22 (shown in FIG. 4) of MicroSD card connector 3 can connect electrically with contact pins 15 which extend within the interior of the common housing through one or more of walls 4, 8, 9, 10, or 11 to be mounted to a printed circuit board by soldering, surface mount technology, press fitting, or other means of mounting connectors to printed circuit boards known in the art.

The combination connector 1 described herein can be used with any standard MicroSD card 6 which can include a flash memory in accordance with the MicroSD card specifications or with prior art MicroSD cards. MicroSD cards 6 are made to a specific size outlined in the MicroSD standard.

MicroSD cards are made with push/pull function and without push/pull function and this invention is not limited to either type.

The combination connector 1 can include an integrated circuit (IC) chip 24 in the housing. IC chip 24 can be operative for analyzing network transmission data on one or more contact pins of female USB connector 2 and for storing said data in a flash memory of a MicroSD card 6 inserted into the MicroSD card connector 3. Also or alternatively, the combination connector 1 can include the same IC chip 24 or a different IC chip in the common housing that is operative for facilitating electro-connectivity between contacts of male USB connector 5 and the contacts of the female USB connector 2 when the male USB connector is inserted into the female USB connector.

MicroSD card connector 3 can operate under the control of IC chip 24 and/or any suitable and/or desirable controller coupled to MicroSD card connector 3 via contact pins 15 to read data from and/or write data to a flash memory of a MicroSD card 6 inserted into MicroSD card connector 3. The operation of MicroSD card connector 3 to read data from and/or write data to a flash memory of a MicroSD card 6 inserted into MicroSD card connector 3 is well known in the art.

While the present invention has been described with reference to an embodiment of a combination USB connector and MicroSD card reader connector in a common housing, those skilled in the art may make modifications and alterations to the present invention without departing from the scope and spirit of the invention. For example, MicroSD card connector 3 can be replaced with any suitable and/or desirable flash card memory connector, HDMI connector, or SATA connector, now known or hereinafter developed, whereupon the combination connector 1 includes USB connector 2 and one of these replacement connectors. The standards of USB connectors and MicroSD card connectors for insertion of MicroSD cards are known in the art. Accordingly, the above detailed description is intended to be illustrative rather than restrictive. The invention is defined by the appended claims, and all changes to the invention that fall within the meaning and range of equivalency of the claims are to be embraced by their scope.

The invention claimed is:

1. A combination female USB connector and female MicroSD flash card connector comprising:

a plurality of walls defining a housing;

a female USB connector and a female MicroSD flash card connector inside the housing;

contact pins extending from contacts of the female USB connector and contacts of the female MicroSD flash card connectors through at least one wall of the housing for connection to a substrate;

electromagnetic interference (EMI) shielding on one or more of the walls; and an integrated circuit (IC) chip in the housing, wherein said IC chip is operative for one of the following:

analyzing network transmission data on one or more contact pins of the female USB connector and for storing said data in a memory of a MicroSD flash card inserted in the female MicroSD flash card connector; or facilitating electrical connectivity between contacts of a male USB connector and the contacts of the female USB connector when the male USB connector is inserted into the female USB connector.

2. The combination female USB connector and female MicroSD flash card connector of claim 1, wherein the plurality of walls include top and bottom walls, right and left side walls extending between the top and bottom walls, and a rear wall.

3. The combination female USB connector and female MicroSD flash card connector of claim 1, wherein the female USB connector and female MicroSD flash card connector are positioned adjacent each other vertically or horizontally within the housing.

4. The combination female USB connector and female MicroSD flash card connector of claim 1, wherein the housing includes in one of the plurality of walls:

a first opening configured to facilitate insertion of a male USB connector into the female USB connector; and a second opening configured to facilitate insertion of a MicroSD flash card into the female MicroSD flash card connector.

5. The combination female USB connector and female MicroSD flash card connector of claim 1, wherein the IC chip is further operative for collecting and storing connectivity data in a memory of a MicroSD flash card inserted in the female MicroSD flash card connector.

6. The combination female USB connector and female flash card connector of claim 1, wherein:

the USB connector is a USB type-A connector, or a USB type-B connector, or a USB type mini-A connector, or a USB type mini-B connector, or a USB type micro-A connector, or a USB type micro-B connector.

* * * * *